US007932885B2

(12) United States Patent
Murade

(10) Patent No.: US 7,932,885 B2
(45) Date of Patent: Apr. 26, 2011

(54) ELECTRO-OPTICAL DEVICE AND ELECTRONIC APPARATUS WITH DUMMY DATA LINES OPERATED SUBSTANTIALLY SIMULTANEOUSLY

(75) Inventor: Masao Murade, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 991 days.

(21) Appl. No.: 11/057,852

(22) Filed: Feb. 15, 2005

(65) Prior Publication Data

US 2005/0206969 A1 Sep. 22, 2005

(30) Foreign Application Priority Data

Mar. 19, 2004 (JP) ..... 2004-081518

(51) Int. Cl.
*G09G 3/36* (2006.01)

(52) U.S. Cl. ..... 345/100; 345/103

(58) Field of Classification Search ..... 345/103, 345/93, 98, 99, 100, 96; 229/314
See application file for complete search history.

(56) References Cited

U.S. PATENT DOCUMENTS

| | | | | |
|---|---|---|---|---|
| 5,513,028 | A * | 4/1996 | Sono et al. | 349/139 |
| 5,699,076 | A * | 12/1997 | Tomiyasu | 345/103 |
| 5,883,609 | A | 3/1999 | Asada et al. | |
| 6,049,321 | A * | 4/2000 | Sasaki | 345/99 |
| 6,232,939 | B1 | 5/2001 | Saito et al. | |
| 6,262,702 | B1 * | 7/2001 | Murade | 345/87 |
| 6,396,470 | B1 * | 5/2002 | Zhang et al. | 345/87 |
| 6,501,456 | B1 | 12/2002 | Saito et al. | |
| 6,909,411 | B1 * | 6/2005 | Yamazaki et al. | 345/87 |
| 6,963,385 | B2 * | 11/2005 | Aruga et al. | 349/151 |
| 7,038,645 | B2 * | 5/2006 | Ozawa et al. | 345/89 |
| 2003/0193465 | A1 * | 10/2003 | Ohkawa et al. | 345/100 |
| 2004/0004595 | A1 * | 1/2004 | Isami et al. | 345/89 |
| 2004/0041764 | A1 * | 3/2004 | Koyama et al. | 345/87 |
| 2004/0041765 | A1 * | 3/2004 | Koyama et al. | 345/87 |
| 2005/0179635 | A1 | 8/2005 | Murakami et al. | |

FOREIGN PATENT DOCUMENTS

| | | |
|---|---|---|
| EP | 0 483 972 A2 | 5/1992 |
| EP | 1 191 513 A2 | 3/2002 |
| EP | 1191513 A2 * | 3/2002 |
| JP | A-08-122748 | 5/1996 |
| JP | A-10-149139 | 6/1998 |
| JP | A-11-237611 | 8/1999 |
| JP | A-11-282426 | 10/1999 |
| JP | 2000-112437 | 4/2000 |

(Continued)

OTHER PUBLICATIONS

"A CMOS image sensor for low light applications", Honghao Ji, Pamela A. Abshire, Circuits and Systems, 2006.*

*Primary Examiner* — Chanh Nguyen
*Assistant Examiner* — Ram A Mistry
(74) *Attorney, Agent, or Firm* — Oliff & Berridge, PLC

(57) ABSTRACT

Signals are respectively output from a first stage and a last stage in a shift register to which a plurality of latch circuits are connected to each other. Based on the signals, data lines are selected. A dummy pixel region comprising pixels corresponding to the selected data lines and data lines adjacent to the selected data lines becomes a non-display region. Therefore, degradation of image quality is suppressed.

7 Claims, 9 Drawing Sheets

FOREIGN PATENT DOCUMENTS

| | | |
|---|---|---|
| JP | A 2000-171774 | 6/2000 |
| JP | A-2000-242237 | 9/2000 |
| JP | A 2003-162265 | 6/2003 |
| JP | 2004-004624 | 1/2004 |
| JP | A 2004-013050 | 1/2004 |
| JP | 2004-054058 | 2/2004 |
| JP | A-2005-258424 | 9/2005 |

* cited by examiner

ELECTRO-OPTICAL DEVICE AND ELECTRONIC APPARATUS WITH DUMMY DATA LINES OPERATED SUBSTANTIALLY SIMULTANEOUSLY

BACKGROUND

The present invention relates to a technology for suppressing degradation of image quality in the case that data lines are driven in a block for a plurality lines.

In recent years, a projector for using an electro-optical panel such as liquid crystal to form small images and for amplifying and projecting the small images on a screen or a wall by an optical system has been widely used. The projector does not have a function to make images on its own, but receives image data (or image signals) from some higher level devices such as a PC or a television tuner. The image data designates a gray scale level (brightness) of a pixel, and are supplied in a vertical scanning type or a horizontal scanning type to pixels arranged in a matrix, so that it is desirable even for an electro-optical panel for use in a projector to be driven in these types. Therefore, the electro-optical panel for use in the projector selects scanning lines one after another, and sequentially selects data lines one by one for a period (one horizontal scanning period) where one scanning line is selected, and the image data are generally driven in a point sequential method, such that the image data transformed to be suitable for driving the liquid crystal are supplied to the selected data line.

However, recently, there has been a strong demand for high precision to correspond to a high vision. High-definition can be achieved by increasing the number of scanning lines and the number of data lines and thus one horizontal scanning period becomes reduced due to the increase in the number of scanning lines. Furthermore, with the point sequential method, a period for selecting data lines is also reduced due to the increase in the number of data lines. For this reason, with the point sequential method, a sufficient time cannot be obtained to supply image signals to the data lines as the high definition progresses, causing the pixels to be insufficiently written.

Here, with a purpose of solving the insufficient writing described above, a phase expansion driving has been proposed. The phase expansion method refers to a method in which a predetermined number of the data lines (e.g., 6 data lines) are selected for every one horizontal scanning period, and image signals of the pixels corresponding to intersections of the selected scanning lines and the selected data lines are selected and extended by 6 times along a time axis to supply to each of 6 data lines. It has been understood that the phase expansion driving is appropriate to high definition since the time to supply image signals to the data lines can be extended 6 times longer than that for the point sequential method.

However, in the phase expansion drive, the plurality of data lines are selected at the same time, resulting in degradation of image quality.

The present invention is contrived to solve the above problems, and an object of the present invention is to provide an electro-optical device and an electronic apparatus capable of suppressing degradation of image quality and displaying high level image quality.

SUMMARY

One aspect of the present invention is to provide an electro-optical device having a plurality of pixels arranged correspondingly to intersections of a plurality of scanning lines and a plurality of data lines, for producing gray scale levels in response to given image signals when image signals are sampled in the plurality of data lines for a period where the plurality of scanning lines are selected, the plurality of data lines being blocked for a plurality of lines, the electro-optical device comprising: a scanning line driving circuit for selecting the plurality of scanning lines for the respective horizontal scanning periods one after another; a shift register connected to a plurality of stages for transmitting a plurality of transmission start pulse signals initially supplied for the respective horizontal scanning periods one after another according to a predetermined clock signal; and a plurality of sampling switches, each electrically interposed between each data line and any of image signal lines that supplies image signals, for sampling the image signals supplied to the image signal lines into the data lines, wherein the signals are turned on and off substantially at the same time based on the pulse signal transmitted to the same stage of the shift register corresponding to the same block of data lines, wherein, among the shift register connected to the plurality of stages, pixel regions corresponding to data lines selected based on the pulse signal transmitted to the first stage to which the transmission start pulse signal is input are not displayed as dummy pixel regions. Among the shift register connected to the plurality of stages, the pulse signals output from the first stage are output based only on the clock signals, while the pulse signals output from the second and subsequent stages are output to be latched based on the clock signals. For this reason, the pulse signals output from the first stage may have different waveforms from those of the pulse signals output from the second and subsequent stages. According to the electro-optical device of the present invention, the region in which the image signals are sampled using the pulse signals output from the first stage is regarded as non-display one, as the dummy pixel regions, so that degradation of the display quality is prevented in advance.

In addition, according to the electro-optical device of the present invention, various aspects of causing pixels to be non-display ones as dummy pixel regions can be provided, such as an aspect of causing the given pixels to be a predetermined color (e.g., black, white, and gray colors) irrespective of display content, an aspect of blocking the given pixels with a light blocking layer, and an aspect of partially or fully forming the pixel circuits.

However, when the pixel regions corresponding to the first stage are used as the dummy pixel regions, a central position of the effective pixel regions for performing a display is obviated from the central position of an entire pixel region. Thus, according to the electro-optical device of the present invention, the pixels corresponding to the data lines selected based on the pulse signals transmitted to the last stage of the shift register may preferably be also non-display ones as dummy pixel regions.

In addition, according to the electro-optical device of the present invention, among the data lines connected to the sampling switch turned on and off based on the pulse signals output from the second stage of the shift register, the pixels corresponding to the dummy pixel regions based on the pulse signals output from the first stage may preferably be also non-display ones. This is because, among the pixel regions corresponding to the second stage, the region adjacent to the pixel regions corresponding to the first stage is susceptible to the effect (such as capacitive couplings) of the pixel regions corresponding to the first stage.

In these arrangements, since there may be a case where a mirror-reversed image is formed, the dummy pixel regions may preferably be symmetrically located with respect to the center of an effective pixel region for performing display. In addition, when the image regions corresponding to the first and the last stage are dummy pixel regions or when the dummy pixel regions are symmetrically located with respect to the center of the effective pixel region, the number of data lines in the effective pixel region may preferably be a multiple number of the number of the sampling switches turned on and off substantially at the same time.

The electro-optical device of the present invention may further comprise an operation circuit for requesting a plurality of signals logically operated with the pulse signals transmitted to each stage of the shift register and an enable signal such that each pulse width does not overlap with each other, and the sampling switch corresponding to the same block may turn on and off according to the same logical operation signals. With this arrangement, the number of stage in the shift register is reduced and it is easily solve a situation where the sampling switches for each block is overlapping turned on.

According to this arrangement, each image signal may preferably be extended along a time axis according to the number of image signal lines, by synchronizing signals that designate gray scale levels of the pixels with the enable signal, and distributed over the image signal line to supply the data line turned on by the sampling switch. With this arrangement, a longer period in which image signals are supplied to the data lines can be obtained.

In addition, an electronic apparatus according to the present invention comprises the electro-optical device as a display unit, so that degradation of image quality can be undetectable.

DETAILED DESCRIPTION OF EMBODIMENTS

Figure 1:
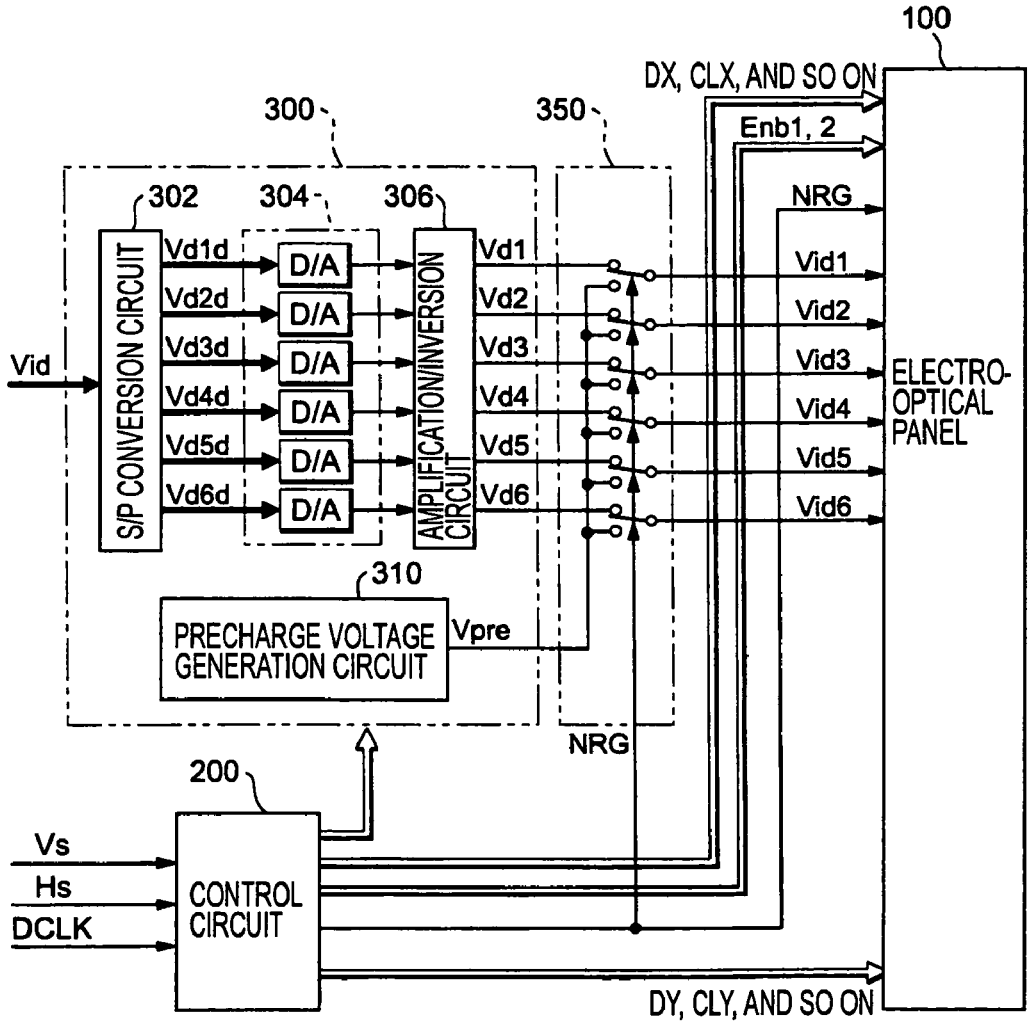
FIG. 1 is a block diagram showing an arrangement of an electro-optical device according to an embodiment of the present invention.

Hereinafter, an exemplary embodiment of the present invention will be described with reference to the attached drawings. FIG. 1 is a block diagram showing an overall arrangement of an electro-optical device according to an embodiment of the present invention.

As shown in FIG. 1, the electro-optical device comprises an electro-optical panel 100, a control circuit 200, and a processing circuit 300.

Among these, the control circuit 200 generates a timing signal or a clock signal for controlling each unit according to a vertical scanning signal Vs, a horizontal scanning signal Hs, and a dot clock signal DCLK, supplied from a higher level device (not shown).

Further, the processing circuit 300 comprises an S/P conversion circuit 302, a plurality of D/A converters 304, and an amplification/inversion circuit 306.

Figure 5:
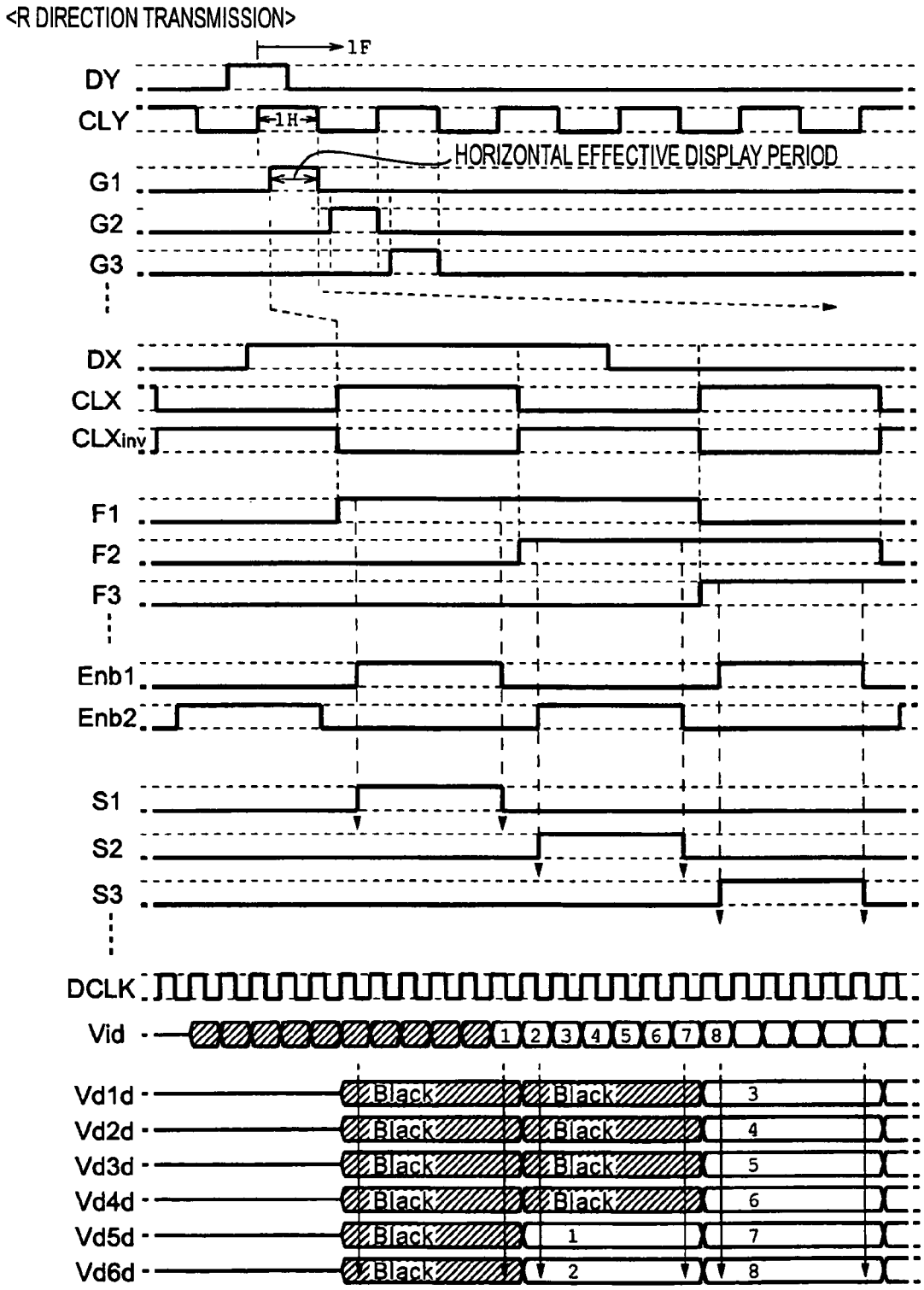
FIG. 5 is a timing chart showing operation of the electro-optical device shown in FIG. 1.

Among these, the S/P conversion circuit 302 distributes image data Vid that designate gray level (brightness) of the pixels supplied from the higher level device in a serial manner as a digital value for each pixel in synchronization with the vertical scanning signal Vs, the horizontal scanning signal Hs, and the dot clock signal DCLK, into 6 systems, or channels ch1 to ch6, and extends the image data Vid by six times along a time axis (S/P conversion) to output as image data Vd1*d* to Vd6*d*, as shown in FIG. 5. Therefore, when the image data for one pixel is supplied for one period of the dot clock signal DCLK, the extended image data Vd1*d* to Vd6*d* are respectively supplied through 6 periods of dot clocks DCLK. In addition, the serial-parallel conversion (S/P conversion) is performed to extend the time in which the image signals are applied and obtain a sample and hold time and a sufficient charging and discharging time for the sampling switch described below.

In addition, according to the present embodiment, the S/P conversion circuit 302 outputs image data to blacken the pixels, for example, in synchronization with a selection time of the image belonging to a dummy pixel region described below.

The D/A converters 304 are D/A converters arranged for each channel ch1 to ch6, and the image data Vd1*d* to Vd6*d* convert voltages corresponding to the gray scale levels of the respective pixels into analog image signals.

The amplification/inversion circuit 306 rotates the analog converted image signals rotated clockwise and counterclockwise using the voltage Vc as a basis, and then, amplifies and supplies them as the image signals Vd1 to Vd6 in an appropriate manner. Here, while the polarity inversion can be performed in various aspects such as those (a) for every scanning line, (b) for every data line, (c) for every pixel, and (d) for every plane (frame), an embodiment of the present invention employs a polarity inversion (a) for every scanning line. However, the present invention is not limited hereto.

Figure 6:
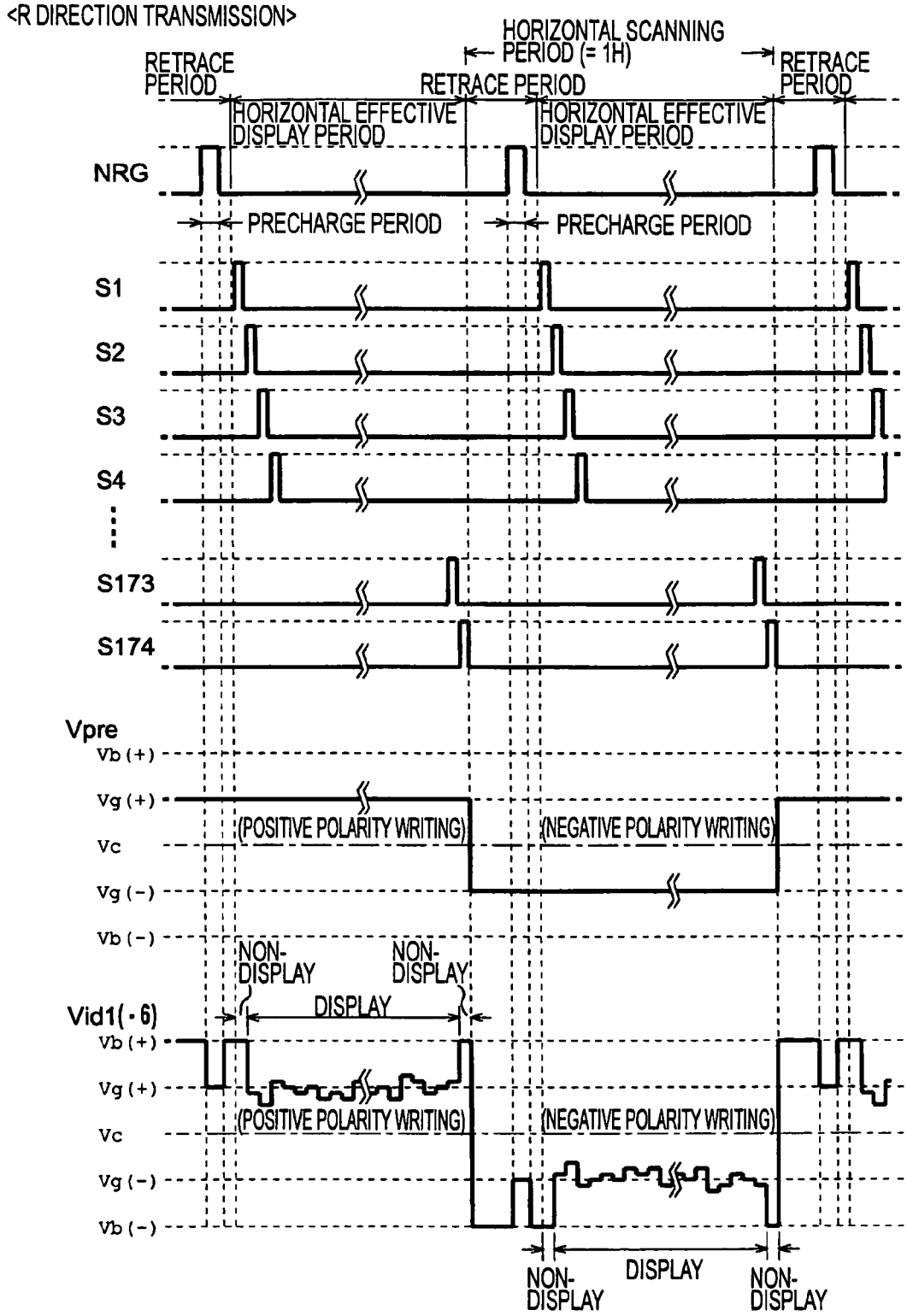
FIG. 6 is a timing chart showing operation of the electro-optical device shown in FIG. 1.

In addition, the voltage Vc is an amplitude center voltage of an image signal, as shown in FIG. 6, and is roughly the same as a voltage LCcom applied to a counter electrode. Further, according to an embodiment of the present invention, for the sake of convenience, a voltage higher than the amplitude center voltage is referred to as a positive voltage, and a voltage lower than the amplitude center voltage is referred to as a negative voltage, respectively.

A precharge voltage generation circuit 310 generates a voltage signal Vpre for precharging, for a retrace period immediately prior to sampling the image signals into the data lines. In addition, according to an embodiment of the present invention, a graying voltage (gray-like voltage) that is an intermediate value between a highest gray scale or white color, and a lowest gray scale or black color is used as a precharge voltage signal Vpre.

As described above, according to an embodiment of the present invention, polarity is inverted for every scanning line, so that, in one horizontal scanning period, a positive polarity writing and a negative polarity writing are alternatively performed for every one horizontal scanning period. For this reason, the precharge voltage generation circuit 310 inverts and generates the precharge voltage signal Vpre for every one horizontal scanning period to be a positive gray-like voltage Vg(+) for a retrace period immediately prior to the positive polarity writing, or to be a negative gray-like voltage Vg(−) for a retrace period immediately prior to the negative polarity writing, respectively, as shown in FIG. 6.

Returning back to FIG. 1, a selector 350 selects the image signals Vd1 to Vd6 by using the amplification/inversion circuit 306 when a signal NRG is an L level, for example, while selecting the precharge voltage signal Vpre by using the precharge voltage generation circuit 310 when a signal NRG is an H level, so that each selected signal is supplied to the electro-optical panel 100 as Vid1 to Vid6. Here, the signal NRG is supplied from the control circuit, and is a signal that is in an H level for a precharge period or a portion of a retrace period.

Therefore, the signals Vid1 to Vid6 become the precharge voltage signal Vpre in common, for a precharge time where the signal NRG is an H level, and become the image signals Vd1 to Vd6, respectively, for other periods.

Figure 2:
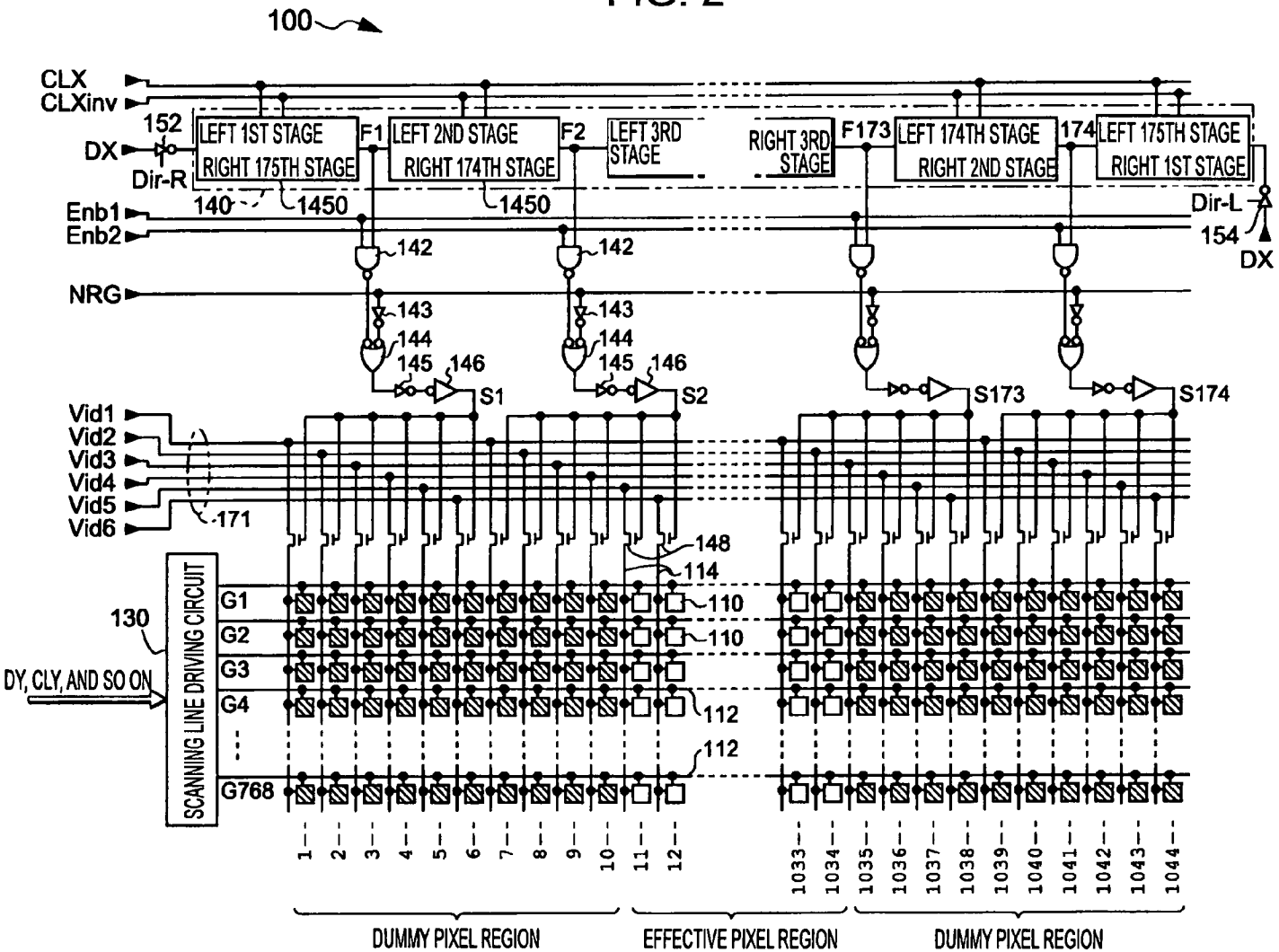
FIG. 2 is a block diagram showing an arrangement of an electro-optical panel for the electro-optical device shown in FIG. 1.

Next, a detailed arrangement of the electro-optical panel 100 will be described. FIG. 2 is a block diagram showing an electrical arrangement of the electro-optical panel 100. The electro-optical panel 100 is a liquid crystal panel in which an element substrate and a counter substrate where counter electrodes are provided are attached with a gap therebetween and liquid crystal is sealed into the gap.

In the electro-optical panel 100, as shown in FIG. 2, 768 scanning lines 112 are horizontally extended in the drawing, while 1044 (6×174) data lines 114 are vertically arranged in the drawing. Further, pixels 110 are arranged at intersections between scanning lines 112 and data lines 114.

Here, the pixels 110 are arranged in a matrix type of 768 vertical rows and 1044 horizontal columns. However, according to an embodiment of the present invention, the leftmost ten columns and the rightmost ten columns in the pixel arrangements that do not attribute to the display are used as dummy pixel regions. For this reason, according to an embodiment of the present invention, a display contributing region or an effective pixel region is 768 vertical rows and 1024 horizontal columns corresponding to a region excluding each leftmost and rightmost ten columns.

Next, a detailed arrangement of the pixel 110 will be described with reference to FIG. 3.

Figure 3:
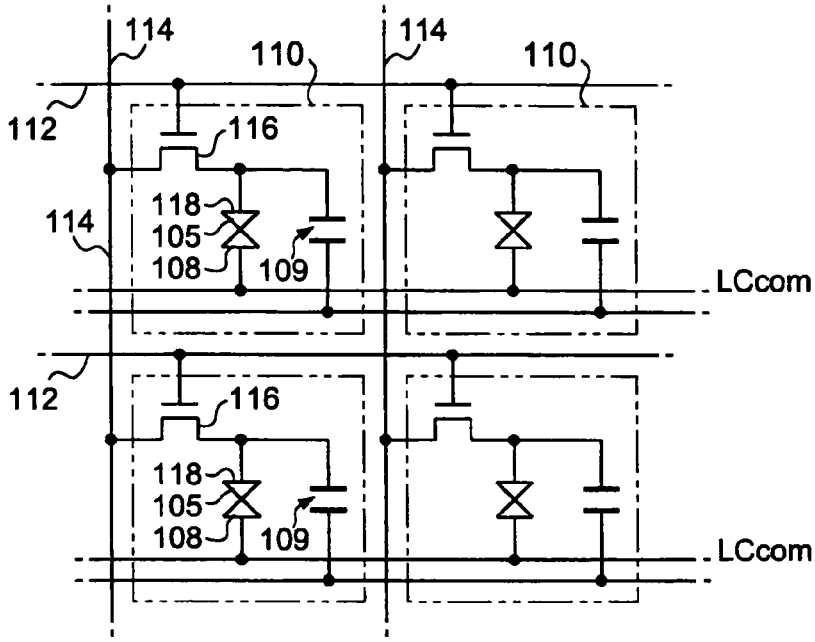
FIG. 3 is a diagram showing an arrangement of a pixel for the electro-optical panel shown in FIG. 2.

As shown in FIG. 3, for the pixel 110, an N-channel type TFT (thin film transistor) 116 has a source connected to a data line 114, a drain connected the pixel electrode 118, and a gate connected to the scanning line.

In addition, the counter electrode 108 is commonly arranged for all the pixels to face the pixel electrode 118, and a liquid crystal layer 105 is interposed between the pixel electrode 118 and the counter electrode 108. For this reason, a liquid crystal capacitor comprises the pixel electrode 118, the counter electrode 108, and the liquid crystal layer 105, for each pixel.

In addition, though not specifically shown, on each facing surface of both substrates, a rubbing processed alignment film is arranged such that a long axis direction of the liquid crystal molecules are consecutively tilted, for example, about 90 degrees between both substrates, while a polarizer is arranged on each opposing side of both substrates, according to the direction of alignment.

Light transmitting between the pixel electrode 118 and the counter electrode 108 is rotated about 90 degrees as the liquid crystal molecules are tilted when the effective voltage of the liquid crystal capacitance is zero, while the liquid crystal molecules are tilted in the direction of an electric field as the given effective voltage grows. As a result, an optical rotation disappears. Therefore, for a transmissive type, in a case of a normal white mode in which a polarizer having a polarizing axis corresponding to an alignment direction is arranged on an incident side and the opposing side, respectively, when the effective voltage of the liquid crystal capacitor is zero, the light transmittance becomes the maximum to perform a white display, while as the effective voltage grows larger, an amount of light is reduced, resulting in the minimum transmission or black display.

In addition, to prevent charge leakage in the liquid crystal capacitor, a storage capacitor 109 is arranged for every pixel. One end of the storage capacitor 109 is connected to the pixel electrode 118 (drain of the TFT 116), while the other end thereof is commonly grounded through all pixels.

Referring still to FIG. 3, around the effective pixel region and the dummy pixel region, peripheral circuits such as a scanning line driving circuit 130 or a shift register 140 are arranged. Among these, the scanning line driving circuit 130 supplies scanning signals G1, G2, G3, . . . , and G768 that are in an L level only for one horizontal effective display period one after another, to 1st, 2nd, 3rd, . . . , and 768th row of the scanning lines, respectively, as shown in FIG. 5. In addition, the detailed description on the scanning line driving circuit 130 is omitted since it is not relevant to the present invention, but the scanning line driving circuit 130 has an arrangement such that a waveform shaping processing is performed, for example, a transmission start pulse DY firstly supplied of one vertical scanning period 1F is shifted one after another each time that a level of a clock signal CLY transits (up or down), and then, reduces a pulse width to output as the scanning signals G1, G2, G3, . . . , and G768.

Next, the shift register 140 refers to 175 stages of latch circuits 1450 connected in parallel, for transmitting the transmission start pulses DX one after another, according to clock signal CLX having a duty ratio of almost 50%, and a clock signal CLXinv having a logical inversion relationship with the clock signal CLX. Here, the transmission start pulse DX is supplied at the start time of one horizontal scanning period, referring to a signal having a pulse width (a period for an H level) of almost one period of the clock signal CLX.

A shift register 140 has an arrangement such that the transmission start pulse can be transmitted either to the right direction (R direction or clockwise direction) or to the left direction (L direction or counterclockwise direction). Signals Dir-R, Dir-L, having logic levels exclusive with each other designate the transmission direction, and a transmission toward the R direction is indicated when the signal Dir-R is an H level (when the signal Dir-L is a L level) while a transmission toward the L direction is indicated when the signal Dir-L is an H level (when the signal Dir-R is a L level).

In the R direction transmission, the latch circuit 1450 uses a left end as an input and a right end as an output. Thus, in the latch circuit 1450, the left 1st stage, left 2nd stage, . . . , and left 174th stage, and left 175th stage are represented from the left of the drawing one after another. In the R direction transmission, the signals F1, F2, . . . , F174 are output from the left 1st stage, left 2nd stage, . . . , left 174th stage of the latch circuit 1450, respectively.

In contrast, in the L direction transmission, the latch circuit 1450 uses a right end as an input and a left end as an output. Thus, in the latch circuit 1450, the right 1st stage, right 2nd stage, . . . , and right 174th stage, and right 131 st stage are represented from the left of the drawing one after another. In the L direction transmission, the signals F174, F173, . . . , F1 are output from the right 1st stage, right 2nd stage, . . . , right 174th stage of the latch circuit 1450, respectively.

In addition, the left 2nd stage of the latch circuit 1450 is the same as the right 174th stage of the latch circuit 1450, for example. Therefore, according to an embodiment of the present invention, there is no discrimination of an even numbered stage and an odd numbered stage between the R direction transmission (counting from the left) and the L direction transmission (counting from the right).

A clocked inverter 152 supplies the transmission start pulse DX as an input to the left 1st stage of the latch circuit 1450 only in the R direction transmission where the signal Dir-R is in the H level. Further, a clocked inverter 154 supplies the transmission start pulse DX as an input to the right 1st stage of the latch circuit 1450 only in the R direction transmission where the signal Dir-L is in the H level.

Figure 4:
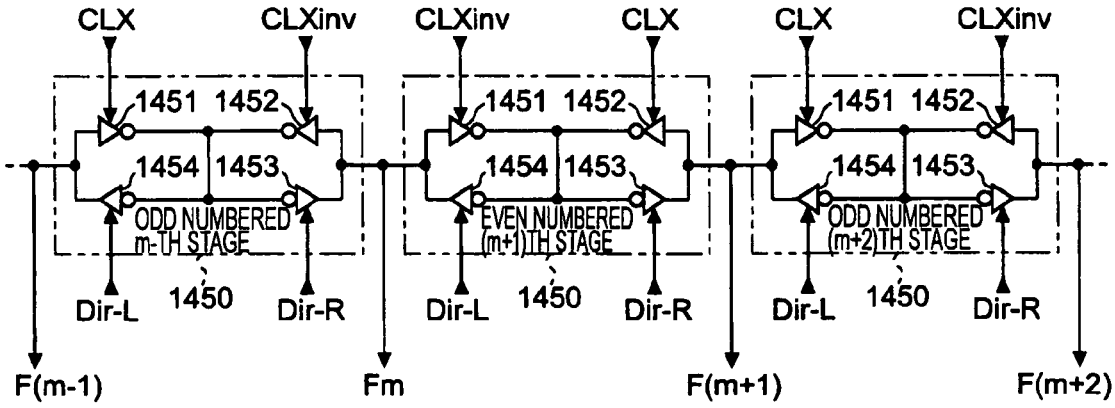
FIG. 4 is a diagram showing an arrangement of a shift register for the electro-optical device shown in FIG. 1.

Here, the latch circuit 1450 of the shift register 140 will be described in detail with reference to FIG. 4. FIG. 4 is a diagram showing an arrangement comprising three stages, or an odd numbered mth stage of the latch circuit 1450, an even numbered (m+1)th stage of the latch circuit 1450, and an odd numbered (m+2)th stage of the latch circuit 1450.

Every latch circuit 1450 has four clocked inverters 1451 to 1454. Among these, for the odd numbered stage of the latch circuit 1450, the clocked inverter 1451 inverts a logic level of the input signal when the clock signal CLX is in the H level, and makes the output in a high impedance when the clock signal CLX is in the L level, while the clocked inverter 1452 inverts a logic level of the input signal when the clock signal CLXinv is in the H level, and makes the output in a high impedance when the clock signal CLXinv is in the L level. Further, the clocked inverter 1453 inverts a logic level of the input signal when the clock signal Dir-R is in the H level, and makes the output in a high impedance when the clock signal Dir-R is in the L level, while the clocked inverter 1454 inverts a logic level of the input signal when the clock signal Dir-L is in the H level, and makes the output in a high impedance when the clock signal Dir-L is in the L level.

For the even numbered stage of the latch circuit 1450, it is reversible to the odd numbered one in terms of the supply relation between the clocked inverters 1451 and 1452 and the clock signals CLX and CLXinv. For this reason, for the even numbered stage of the latch circuit 1450, the clocked inverter 1451 inverts a logic level of the input signal when the clock signal CLXinv is in the H level, and makes the output in a high impedance when the clock signal CLXinv is in the L level, while the clocked inverter 1452 inverts a logic level of the input signal when the clock signal CLX is in the H level, and makes the output in a high impedance when the clock signal CLX is in the L level. In addition, the clocked inverters 1453 and 1454 do not have any difference between the odd numbered stage and the even numbered stage.

The shift register 140 has an arrangement in which the odd numbered stage of the latch circuit 1450 and the even numbered stage of the latch circuit 1450 are alternatively connected.

With the arrangement described above, in the R direction transmission, the output of the clocked inverter 1454 is in the high impedance throughout all stages, so that it is electrically negligible, while the clocked inverter 1453 is a simple NOT circuit.

First, when the clock signal CLX is in the H level, for the odd numbered stage of the latch circuit 1450, the clocked inverter 1451 inverts a logic level of the input signal from the left end and supplies the logic level to the input stage of the clocked inverter 1453, and the clocked inverter 1453 re-inverts the logical level of the signal supplied to the input stage to supply to input stage of the clocked inverter 1452 along with the output signal from the latch circuit 1450. Here, when the clock signal CLX is in the H level, the output of the clocked inverter 1452 for the odd numbered stage becomes a high impedance state. Therefore, when the clock signal CLX is in the H level, the output of the clocked inverter 1453 or the output signal of the odd numbered stage is designated based only on the output level of the clocked inverter 1451. Thus, in the R direction transmission, when the clock signal CLX is in the H level (the clock signal CLXinv is in the L level), the signal Fm output from the odd numbered stage of the latch circuit 1450 is a clockwise rotated signal that repeats twice the logic inversion of the input signal at the left end.

Next, when the clock signal CLX is in the L level and the clock signal CLXinv is in the H level, for the odd numbered stage of the latch circuit 1450, the clocked inverter 1452 inverts the logic level of the output signal by using the clock inverter 1453 and is fed back to the given clocked inverter 1453. In addition, for a period when the clock signal CLXinv is in the H level, the output of the clocked inverter 1451 for the odd numbered stage is in the high impedance. Therefore, in the R direction transmission, when the clock signal CLX is in the L level (clock signal CLXinv is in the H level), the signal Fm output from the odd numbered mth stage of the latch circuit 1450 is a latched one output from the clocked inverter 1453 immediately before the clock signal CLX is in the L level.

For the even numbered stage of the latch circuit 1450, it should be noted that the supply relation between the clocked inverters 1451 and 1452 and the clock signals CLX and CLXinv are reversible with the odd numbered one. Thus, in the R direction transmission, when the clock signal CLX is in the L level, a signal F(m+1) output from the even numbered (m+1) th stage of the latch circuit 1450 becomes a positive signal twice logically inverted from the input signal of the left end, or the signal latched by one stage before the odd numbered m stage of the latch circuit 1450.

In addition, in the R direction transmission, the signal F(m+1) output when the clock signal CLX is in the H level, the clock signal CLX is a latched one output from the clocked inverter 1453 immediately before the clock signal CLX is in the H level.

Therefore, in the R direction transmission, the signal F(m+1) output from the even numbered (m+1)th stage of the latch circuit 1450 is a half period delayed one of the clock signal CLX (clock signal CLXinv) compared to the signal Fm output from the previous stage, or the odd numbered m stage of the latch circuit 1450.

The shift register 140 has an arrangement in which these odd numbered stages and even numbered stages of the latch circuit 1450 are alternatively connected. Thus, in the R direction transmission, when the transmission start pulse DX is supplied to the left 1st stage of the latch circuit 1450 as an input, the signals F1, F2, F3, . . . output from the left 1st stage, left 2nd stage, left 3rd stage, . . . will be as shown in FIG. 5. In other words, the first signal F1 is a signal that rotates the transmission start pulse DX clockwise when the clock signal CLX is in the H level, and a latched one of the immediately previous clockwise rotated output when the clock signal CLX is in the L level. The second signal F2 is a signal latched by the left 1st stage of the latch circuit when the clock signal CLX is in the L level, and a latched one of the immediately previous clockwise rotated output when the clock signal CLX is in the H level, and the following signals are repeated in the same manner. Therefore, the signals F1, F2, F3, . . . , and F174 are shifted one after another by a half period of the clock signal CLX (clock signal CLXinve).

In addition, in the L direction transmission, the output of the clocked inverter 1453 is in the high impedance throughout all stages, so that it is electrically negligible, while the clocked inverter 1454 is a simple NOT circuit. For this reason, the odd number (m+2)th stage of the latch circuit 1450, when the clock signal CLX is in the L level, the clocked inverter 1452 inverts the logic level of the signal input from the right end to supply to the input stage of the clocked inverter 1454, and the clocked inverter 1454 re-inverts the logic level of the signal supplied to the input stage to supply to the input stage of the clocked inverter 1451 where the output is in the high impedance, as well as to output as a signal F(m+1). Therefore, in the L direction transmission, the signal F(m+1) output when the clock CLK is in the L level becomes a clockwise rotated signal that twice rotates the logical inversion of the input signal at the right end.

For the odd numbered (m+2)th stage of the latch circuit 1450, when the clock signal CLX is in the H level, the clocked inverter 1451 inverts the logic level of the signal output by the clock inverter 1454 to feed back to the given clocked inverter 1454. Therefore, in the L direction transmission, the signal F(m+1) output when the clock signal CLX is in the H level is a latched one output from the odd numbered (m+2) stage of the clocked inverter 1454 immediately before the clock signal CLX is in the H level.

Moreover, in the L direction transmission, when the clock signal CLX is in the H level, the signal Fm output from the even numbered (m+1) stage of the latch circuit 1450 is a signal latched by a clockwise rotated signal that repeats twice the logical inversion of the input signal at the right end, or one previous stage of the odd numbered (m+2) stage of the latch circuit 1450.

Next, in the L direction transmission, the signal Fm output when the clock signal CLX is in the L level is a latched one output from the clocked inverter 1454 of the even numbered (m+1) stage immediately before the clock signal CLX is in the L level.

Figure 7:
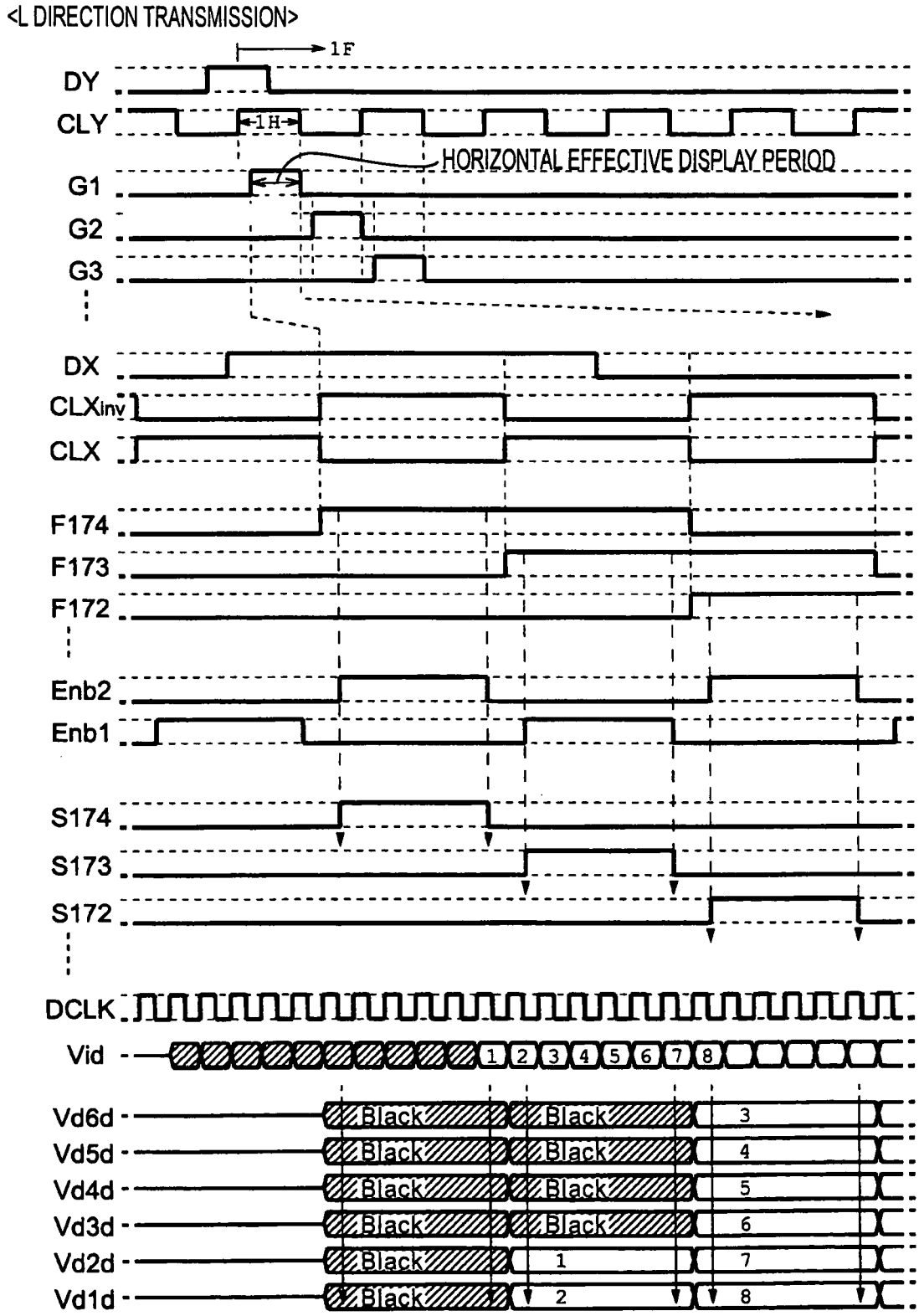
FIG. 7 is a timing chart showing operation of the electro-optical device shown in FIG. 1.

Therefore, in the L direction transmission, when the transmission start pulse DX is supplied to the right 1st stage of the latch circuit 1450 as an input, the signals F174, F173, F172, . . . output from the right 1st stage, right 2nd stage, right 3rd stage, . . . of the latch circuit 1450 are as shown FIG. 7. In other words, the first signal F174 is a signal that rotates the transmission start pulse DX clockwise when the clock signal CLX is in the L level, and a latched one of the immediately previous clockwise rotated output when the clock signal CLX is in the H level. The second signal F173 is a signal latched by the right 1st stage of the latch circuit when the clock signal CLX is in the H level, and a latched one of the immediately previous clockwise rotated output when the clock signal CLX is in the L level, and the following signals are repeated in the same manner. Therefore, the signals F174, F173, F172, . . . , and F1 are shifted one after another by a half period of the clock signal CLX (clock signal CLXinv).

In addition, in FIG. 4, to aid understanding of the description, a complementary arrangement is omitted. Specifically, the clocked inverters 1451, 1452, 1453, and 1454 are well known respectively, each of which complementarily comprises two P-channel type TFTs and two N-channel type TFTs connected in serial in a range from the high level voltage to the low level voltage of the power supply.

Therefore, for example, the clock signal CLX shown in FIG. 4 as well as the clock signal CLXinv is supplied to the odd numbered stage of the clocked inverter 1451, for example. Similarly, for example, the signal Dir-R shown in FIG. 4 as well as the signal Dir-L not shown is supplied to the clocked inverter 1453.

Referring back to FIG. 2, each signal path of the output signals F1, F2, . . . , F174 by the shift register 140 is branched into two, or the right and left directions in FIG. 2, respectively, and in principle, the operation circuit comprising a NAND circuit 142, a NOT circuit 143, a NAND circuit 144, and NOT circuits 145 and 146 is respectively arranged after each branched path.

Here, among supply paths of the signal Fm where m is an odd number, i.e., the signal output from the odd numbered stage of the latch circuit 1450 for the R direction transmission (signal output from the even numbered stage of the latch circuit 1450 for the L direction transmission), the NAND circuit 142 corresponding to the left-branched path of FIG. 2 outputs a NAND signal referred to as the given signal Fm and the enable signal Enb1, while the NAND circuit 142 corresponding to the right-branched path outputs a NAND signal referred to as the given signal Fm and the enable signal Enb1.

In addition, among the signal Fm where (m+1) is an even number, i.e., the signal output from the even numbered stage of the latch circuit 1450 for the R direction transmission (signal output from the odd numbered stage of the latch circuit 1450 for the L direction transmission), the NAND circuit 142 corresponding to the left-branched path of FIG. 2 outputs a NAND signal referred to as the given signal F(m+1) and the enable signal Enb3, while the NAND circuit 142 corresponding to the right-branched path outputs a NAND signal referred to as the given signal F(m+1) and the enable signal Enb2.

Here, enable signals Enb1 and Enb2 are signals supplied from the control circuit 200 (refer to FIG. 1), and phases thereof are shifted by 180 degrees with each other, as shown in FIG. 5. Further, the pulse width of the enable signal Enb1 at a H level is smaller than that of the clock signal CLX at the H level by a predetermined dimension at the front and rear ends of the clock signal CLX at the H level, and the pulse width of the enable signal Enb2 at an L level is smaller than that of the clock signal CLX at the L level by a predetermined dimension at the front and rear ends of the clock signal CLX at the L level.

The NAND circuit 144 outputs a NAND operated signal between a signal NAND operated by the NAND circuit 142 and a signal inverted from the signal NRZ by the NOT circuit 143. The NOR operated signal by the NOR circuit 144 is output as a sampling signal through even times (twice in FIG. 2) of logical inversion by the NOT circuits 145 and 146. Here, the sampling signals of which original signals are respectively signals F1, F2, . . . , and F174 are referred to as S1, S2, . . . , and S174.

In addition, the reason why the NAND circuit 144 performs a NAND operation using NOT circuits 145 and 146 is that it is necessary to branch the signals into 6 and supply the branched signals to a gate of the TFT as a sampling switch 148, with a high driving capacity. For this reason, the size of the transistor is gradually increased to the NOT circuit 145 and 146.

The sampling switch 148 is, for example, an N-channel type TFT, for sampling into the data lines 114 the respective signals Vid1 to Vid6 of six channels supplied through six image signal lines 171 arranged for every data line 114.

Specifically, for the sampling switch 148 in which a drain is connected to one end of the jth data line 114 counting from the left side of FIG. 2, when a remainder that divides j into 6 is '1', the source is connected to the image signal line 171 to which the signal Vid1 is supplied. Similarly, for the sampling 148 in which a drain is connected to the data line 114 when a remainder that divides j into 4 is '2', '3', '4', '5', and '0', respectively, the source is connected to the image signal line 171 to which the signal Vid2 to Vid6 is supplied. For example, the source of the sampling switching in which a drain is connected to the eleventh data line 114 counting from the left side of FIG. 2 is connected to the image signal line 171 to which the signal Vid5 is supplied since the remainder that divides '11' into 6 is '5'.

Moreover, for the data line 114 where the quotient that divides (j−1) into 6 is 'i', each sampling signal S(i+1) is commonly supplied to the gate of 6 sampling switches 148 connected to the drain. For example, for the data line 114 for 7th to 12th columns, (j−1) is '6' to '11', and the quotient that divides the resultant number into 6 is '1' so that the sampling signal S2 is commonly supplied to the gate of the sampling switch 148 corresponding to these data lines 114.

In addition, according to an embodiment of the present invention, six data lines 114 having a relation that the same sampling signal is supplied to the gate of the corresponding sampling switch 148 are regarded as a block.

Next, operation of the electro-optical device according to the embodiment will be illustrated in the context of the R direction transmission. FIGS. 5 and 6 are timing charts for illustrating operation of an electro-optical device in the R direction transmission.

First, for a first one of the horizontal scanning period 1F, a transmission start pulse DY is supplied to a scanning line driving circuit 130. With this, the scanning signals G1, G2, G3, . . . , and G768 are in the H level exclusively only for the horizontal effective display period, as shown in FIG. 5.

Here, with respect to the horizontal effective display period in which the scanning signal G1 is in the H level, for a retrace period prior to the given horizontal effective display period, the signal NRG is in the H level for a precharge period isolated from the front and back end of the retrace period, as shown in FIG. 6. For the horizontal effective display period, in case of the positive polarity writing, the precharge voltage generation circuit 310 makes a precharge voltage signal Vpre a voltage Vg(+) corresponding to the positive polarity writing.

When the signal NRG is in the H level, a selector 350 (ref. FIG. 1) selects the precharge voltage signal Vpre, so that six image signal lines 171 is a voltage Vg(+) corresponding to the positive polarity writing for the immediately following horizontal effective display period.

In addition, when the signal NRG is in the H level, irrespective of the level NAND operated by the NAND circuit 142, the NAND signal by the NAND circuit 144 is forced to be the H level, so that all sampling switches 148 are turned on. Therefore, when the signal NRG is in the H level, the voltage signal Vpre of the image signal line 171 is sampled so that all of the data lines 114 are precharged into Vg(+) as the pre-established positive polarity writing.

In addition, when the precharge period is ended and the signal NRZ is in the L level, the NAND circuit 144 acts as a NOT circuit for inverting a logic level of the NAND signal by the NAND circuit 142.

When the retrace period is ended, the transmission start pulse DX is shifted one after another by each latch circuit 1450 of the shift register 140, and output as the signals F1, F2, F3, . . . through a horizontal effective display period.

Among these, the odd numbered m signal Fm may reduce a pulse width by performing NAND operation of the enable signal Enb1 with the NAND circuit 142, and further, is output as the sampling signal Sm through the NAND circuit 144, and the NOT circuits 145 and 146. Similarly, the even numbered (m+1) signal F(m+1) can reduce a pulse width by performing NAND operation of the enable signal Enb2 with the NAND circuit 142, and further, is output as the sampling signal F(m+1) through the NOT circuit 145 and 146.

Here, positive pulse widths (period for the H level) of the enable signals Enb1 and Enb2 are reduced such that a leading edge and a trailing edge for a period of the H level in which clock signals CLX and CLXinv are the H levels, respectively, are isolated. Thus, the sampling signals S1, S2, S3, . . . , are output such that the positive pulse widths are not overlapped with each other, as shown in FIG. 5.

Further, first, the image data Vid supplied in synchronization with the horizontal period are distributed into six channels by the S/P conversion circuit 302, and extended by six times along the time axis, and secondly, converted into each analog signal by the D/A converters 304, and outputs as a basis of the voltage Vc corresponding to the positive polarity writing. For this reason, the clockwise rotated image signals Vd1 to Vd6 are in the High level voltage compared to the voltage Vc as the pixels are used as black ones.

In addition, for the horizontal effective display period, a signal NRG is the L level. Thus, a selector 350 selects the given image signals Vd1 to Vd6, so that the signals Vid1 to Vid6 supplied to six image signal lines 171 become image signals Vd1 to Vd6 by the amplification/inversion circuit 306.

In addition, in FIG. 6, among signals supplied to six image signal lines 171, a voltage variation of the signal Vid1 corresponding to the channel ch1 is shown. For a retrace period, when the image signals Vd1 to Vd6 are black-like voltages Vb(+) or Vb(−) corresponding to the polarity, the signal Vid1 supplied to the image signal line 171 is some portion of the black-like voltage, and when the signal NRG is the H level, the precharge voltage signal Vpre is provided so that the signal is in gray-like voltages Vg(+) or Vg(−) corresponding to the immediately following writing polarity.

However, for a horizontal effective display period in which the scanning signal G1 is in the H level, when the sampling signal G1 is in the H level, image signals Vd1 to Vd6 are respectively sampled for each of the 1st to 6th data lines 114 counting from the left side of FIG. 2. Further, the sampled image signals Vd1 to Vd6 are respectively applied to the pixel electrode 118 of the pixel 110 corresponding to the intersections of the 1st to 6th data lines 114 and the 1st scanning line 112 counting from the upper portion of FIG. 2.

However, the first to sixth data lines 114 belong to the dummy pixel region, so that the sampled image signals are black-like voltage Vb(+) in response to the positive polarity writing. For this reason, pixels in a range of 1st row×1st column to 1st row×6th column perform a black display.

Next, when the sampling signal S2 is in the H level, at this time, for each of the seventh to twelfth data lines 114, each image signal Vd1 to Vd6 is sampled. In addition, the sampled image signals are respectively applied to the pixel electrode 118 of the pixel 110 corresponding to the intersection between the first row scanning line 112 and the seventh to twelfth data lines 114.

Among these, the seventh to twelfth data lines 114 belong to the dummy pixel regions, so that the sampled image signals are in the black-like voltage Vb(+) identical to the 1st to 6th data lines. For this reason, pixels in the range of 1st row×7th column to 1st row×10th column are blackened.

Meanwhile, the eleventh and twelfth data lines 114 belong to the effective pixel region and the sampled image signals are gray scale levels indicated by the image data Vid, corresponding to the positive polarity writing. For this reason, the pixels in a range of 1st row×11th column to 1st row×12th column are in gray levels indicated by the image data Vid.

Therefore, according to an embodiment of the present invention, the effective pixel that contributes to the display starts from the eleventh one.

Further, when the sampling signal S3 is in the H level, at this time, for each of the thirteenth to eighteenth data lines 114, each image signal Vd1 to Vd6 is sampled. In addition, the sampled image signals Vd1 to Vd4 are respectively applied to the pixel electrode 118 of the pixel 110 corresponding to the intersection between the first row scanning line 112 and the thirteenth to eighteenth data lines 114. Thus, the pixels in a range of 1st row×13th column to 1st row×18th column are in gray levels indicated by the image data Vid.

Hereinafter, the same writing is repeated until the sampling signals S173 and S174 are in the H level, one after another, so that all writings for the first row pixels are completed.

However, when the sampling signal S173 is in the H level, the 1035th to 1038th data lines belong to the dummy pixel region so that the sampled image signals are in the black-like voltage Vb(+). For this reason, pixels in a range of 1st row×1035th column to 1st row×1038th column are blackened. In addition, when the sampling signal S174 is in the H level, the 1039th to 1044th data lines 114 belong to the dummy pixel regions, the sampled image signals are in the black-like voltage Vb(+). For this reason, pixels in the range of 1st row×1039th column to 1st row×1044th column are blackened. In other words, according to the present invention, the pixel that contributes to the display is completed at the 1034th one.

Therefore, according to an embodiment of the present invention, the range of effective pixels contributing the display is from 11th to 1034th, or 1024 columns.

When writing to all first row pixels is completed, the scanning signal G1 becomes to the L level. When the scanning signal G1 becomes to the L level, the TFT 116 connected to the first row scanning line 112 turns off, but due to the storage capacitor 109 and capacitance of the liquid crystal layer itself, the pixel electrode 118 is retained to the voltage written at the time of 'on' so that the gray scale corresponding to the given retention voltage is retained.

Next, among the retrace periods immediately before the scanning signal G2 becomes to the H level, for a precharge period where the signal NRG becomes to the H level, six image signal lines 171 are supplied with the precharge voltage signal Vpre by the precharge voltage generation circuit 310, as described above. However, for the horizontal effective display period where the scanning signal G2 is in the H level, the negative polarity writing is performed for the polarity inversion of every scanning line. Thus, all data lines 114 are precharged into the voltage Vg(−) in response to the negative polarity writing.

Other operations have the same period where the scanning signal is in the H level, and as the sampling signals S1, S2, S3, . . . , S174 are in the H level one after another, among the second row pixels, pixels in a range of 2nd row×1st column to 2nd row×10th column are blackened, and writing for performing the effective display on the 2nd row×11th column to 2nd row×1034th column is performed and pixels in a range of 2nd row×1035th column to 2nd row×1044th column.

Further, the amplification/inversion circuit 306 inverts the analog signal by the D/A converters 304 as a basis of the voltage Vc in response to each negative polarity writing, so that the signals Vid1 to Vid6 (Vd1 to Vd6) correspond to the voltage lower than a voltage Vc, as the pixels are blackened (see FIG. 6).

Hereinafter, similarly, the scanning signals G3, G4, . . . , and G768 are in the H level and writing is performed on the pixels in the 3rd row, 4th row, . . . , 768th. With this, the positive polarity writing for the pixels in the odd numbered rows, and the negative polarity writing for the pixels in the even numbered rows are performed, and for this one vertical scanning period, writing into the 1st to 768th rows of pixels is completed.

Further, for the next one vertical scanning period (1F), the same writing is performed, but at this time, a writing polarity for each row of pixel can be interchanged. In other words, for the next one vertical scanning period, the negative polarity writing for the pixels in the odd numbered rows, and the positive polarity writing for the pixels in the even numbered rows are performed. In this way, since the writing polarity into the pixels for each horizontal scanning period can be interchanged, applying DC component into the liquid crystal is not required so that degradation of the liquid crystal can be prevented. In addition, with the exchanged writing polarity, the precharge voltage signal Vpre is also polarity-inverted.

Figure 8:
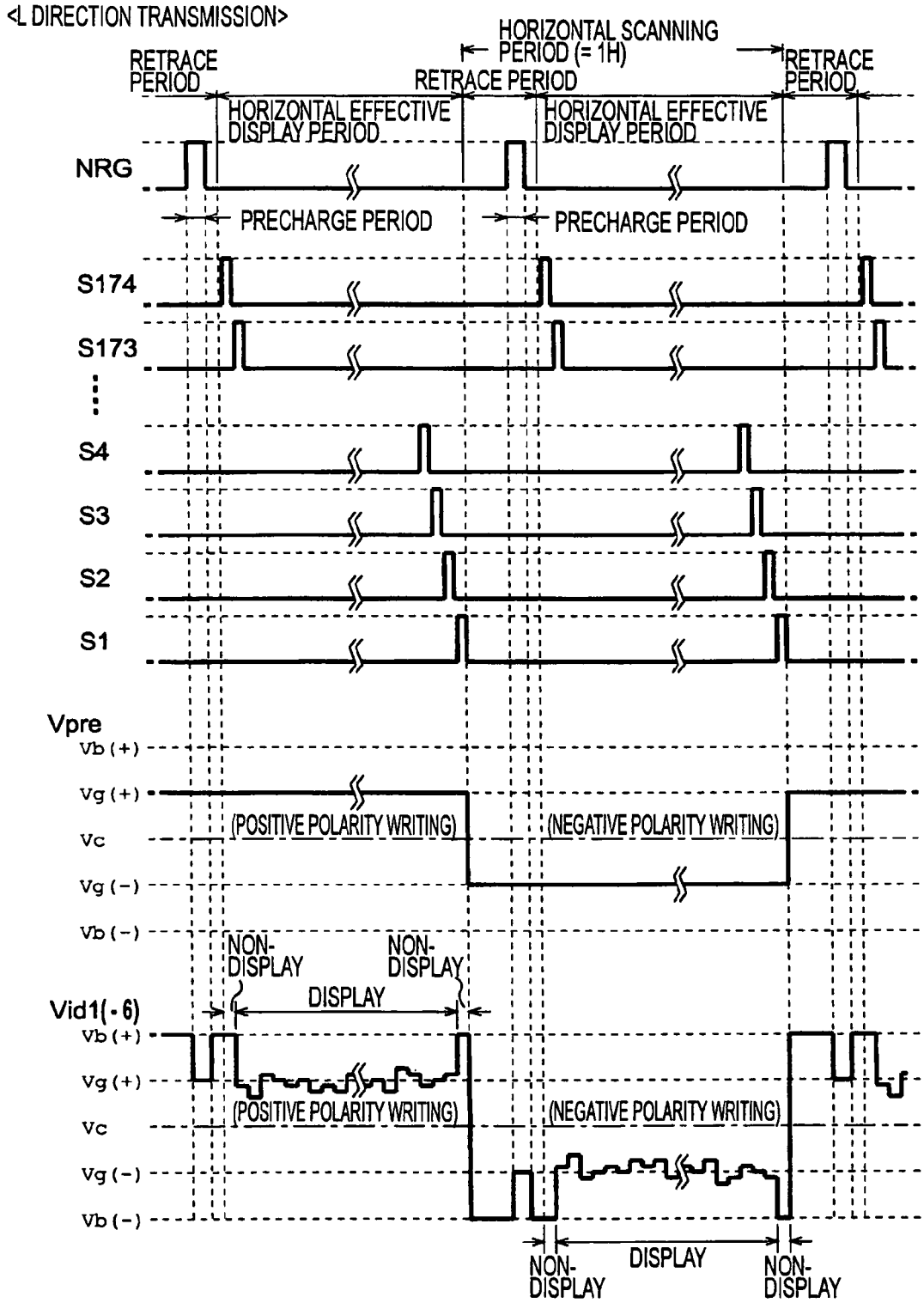
FIG. 8 is a timing chart showing operation of the electro-optical device shown in FIG. 1.

In addition, operation of an L direction transmission is shown in FIGS. 7 and 8, and a difference compared to the R direction transmission is that the sampling signals S174, S173, S172, . . . , and S1 are in the H level one after another, and the distribution sequence of the image signals Vd1 to Vd6 to the image signal line 171 is reversed as the sampling switch 148 and the image signal line 171 are in the block to be fixedly connected. In addition, a phase relation between the clock signals CLX and CLXinv and the enable signals Enb1 and Enb2 is also reversed, but this may be coped by interchanging the signal supply path.

According to the present invention, an effective pixel range that contributes to the display is restricted to the 11th to 1034th pixels, or 1024 pixels in total. Here, the restriction herein will be described below.

As described above, in the R direction transmission, the first half of the positive pulse (H level) in the signal F1 output at first from the shift register 140 is one clockwise rotating the transmission start pulse DX clockwise for a period when the clock signal CLX is in the H level, while the first halves of the positive pulses in the signals F2, F3, . . . , and F174 are respectively obtained by normally outputting the signals latched by the latch circuits at the previous stages. In other words, in the R direction transmission, since the signal F1 to be the first positive pulse does not have a latch circuit at the previous stage, the signal F1 is output under different condition and in waveform from those of other signals F2, F3, . . . , and F174.

The signal F1 can reduce the pulse width by NAND operation of the enable signal Enb1, and through repetition, it is output as a sampling signal S1. However, a ranged to be reduced is a former part of the pulse width having different conditions with other signals F2 and F3. For this reason, a conditional state for sampling the image signal into the data line 114 according to the sampling signal S1 based on the signal F1 is different from a conditional stage for sampling the image signal 114 into the data line 114 according to the sampling signals S2, S3, . . . , and S174 based on the signal F2. Thus, the difference of the display quality is noticeable.

In addition, due to a capacitive coupling between the image signal line 171 and the counter electrode 108, a capacitive coupling between the data line 114 and the counter electrode 108, and resistance of the counter electrode 108, the counter electrode 108 to be constant to the voltage LCcom may varies according to the voltage variation of the image signal line 171.

In the present embodiment, in the case of the R direction transmission for one horizontal scanning period, the image signals are sampled into the data line 114 in the sequence of 1st to 6th, 7th to 12th, and 13th to 18th columns, but for example, due to the voltage variation of the image signal line 171 when the 1st to 6th data lines 114 are selected or the voltage variation of the data line 114 accompanied with the sampling of the image signal, the voltage of the counter electrode 108 may be changed. In the state in which the voltage variation is not converged, when the image signals are sampled to the next 7th to 12th column data lines 114, the counter electrode 108 is not in the voltage LCcom even if the image signal is properly applied to the pixel electrode 118 of the corresponding pixel. Therefore, the voltage retained in the liquid crystal capacitor does not become the predetermined value. This is also applicable to each group after a group of 13th to 18th data lines where the image signals are simultaneously sampled.

With respect to this, for the 1st to 6th data lines 114, there are no data lines 114 in which the image signals are sampled earlier, so that these are not affected by a voltage variation of the counter electrode 108. Therefore, there may occur a display difference between pixels corresponding to the 1st to 6th data lines 114 and pixels corresponding to the 7th and the subsequent data lines 114 affected by the voltage variation.

In particular, according to the present embodiment, an arrangement is provided in which the image signals are sampled into the 6 columns of data lines 114 at the same time, so that it will be appreciated that a unit for representing the display difference is 6 columns, which is noticeable.

According to the present embodiment, the pixel regions of the 1st to 6th data lines are blackened as the dummy pixel regions that do not contribute to the display. For this reason, the degradation of the display quality is suppressed in advance due to a fact that the signal F1 firstly output in one horizontal scanning period is different from other signals F2, . . . , and that the voltage of the counter electrode is changed.

Further, in the L direction transmission, the first half of the positive pulse (H level) in the signal F174 output at first from the shift register 140 is obtained by normally outputting the transmission start pulse DX as it is for a period when the clock signal CLX is in the L level, while the first halves of the positive pulses in the signals F173, F172, . . . , and F1 are respectively obtained by normally outputting the signals latched by the latch circuit at the previous stage. For this reason, a state in which the image signals are sampled to the data lines 114 according to the sampling signal S174 based on the signal F174 is different from a state in which the image signals are sampled to the data lines 114 according to the sampling signals S173, S172, . . . , S1 based on the signals F173, F172, . . . , F1. Therefore, a difference of the display quality is noticeable.

In addition, regarding a voltage variation of the counter electrode for the L direction transmission, there may occur a display difference between pixels corresponding to the 1044th to 1039th data lines 114 and pixels corresponding to the 1038th to 1st data lines 114.

According to the present embodiment, the pixel regions of the 1044th to 1039th data lines are blackened as the dummy pixel regions that do not contribute to the display. Therefore, the degradation of the display quality is suppressed in advance.

However, since the degradation of the display quality results from signals output at first from the shift register 140 for the one horizontal scanning period and a voltage variation of the counter electrode, in the case of the R direction transmission, it will be appreciated that only the region corresponding to the 1st to 6th data lines is designated to be the dummy pixel region so the pixel region of the 1039th to 1044th data lines at the opposite side are not necessarily used as the dummy pixel region.

Similarly, in the L direction transmission, it will be appreciated that only the region corresponding to the 1044th to 1039th data lines is designated to be the dummy pixel region so the pixel region of the 6th to 1st data lines are not necessarily used as the dummy pixel region.

However, as described below, with a three-plane type projector corresponding to RGB, when images corresponding to the respective colors are formed with three electro-optical panels, it is necessary to form a normal for one color and a left-right inverted image for another color and to synthesize these to project.

In this case, when the electro-optical panel is implemented with the dedicated normal image forming one and the dedicated left-right inverted image forming one, a high manufacturing cost is required. Thus, it is advantageous to arrange one electro-optical panel available to both the normal image and the left-right inverted image.

However, with the arrangement described above, in case of the R direction transmission for forming the normal image, only the region corresponding to the 1st to 6th data lines is used as the dummy pixel region, while in case of the L direction transmission for forming the left-right inverted image, only the region corresponding to the 1039th to 1044th data lines is used as the dummy pixel region, which is inappropriate since a center of the normal image and a center of the left-right inverted image are not matched for a panel (entire pixel region).

To solve the inappropriateness, according to the present invention, in the R direction transmission, the pixel region of the 1039th to 1044th data lines is used as the dummy pixel region, and in the L direction transmission, the pixel region of the 6th to 1st data lines is used as the dummy pixel region to obtain the left and right symmetry of the image formed in the panel, in the L direction transmission.

Therefore, when left and right symmetry is not necessary, since it is not necessary to use the pixel region of the 1039th to 1044th data lines as the dummy pixel region in the R direction transmission, the pixel region may be used as the effective pixel region. Similarly, in the L direction transmission, it is possible to use the pixel region of the 6th to 1st data lines as the effective pixel region to contribute to the display.

Next, when display quality is degraded due to a fact that the signal output from the first stage for the shift register 140 is different from other signals output from other stages, and that the voltage of the counter electrode is not changed, it will be appreciated that the necessity that the pixel region corresponding to the 7th to 10th and 1035th to 1038th data lines should be used as the dummy pixel regions is reduced.

However, with an arrangement in which the number of data lines 114 for sampling the image signals with the same sampling signals is '6', as described in the present embodiment, when adapted into an XGA (eXtended Graphics Array) format, the number of pixels in the horizontal direction '1024' is not divisible, but there is a remainder of '4'. According to the present embodiment, the remainder of '4' is located in the effective pixel region by distributing two '2'0 at the right and left sides thereof, for symmetry. As a result, the pixel regions corresponding to the 7th to 10th data lines 114 as well as the 1st to 6th data lines and the pixel regions corresponding to the 1035th to 1038th data lines 114 as well as the 1039 to 1044th data lines are used as the dummy pixel regions.

In addition, the pixel regions corresponding to the 7th to 10th and 1035th to 1038th data lines 114 are adjacent to the 1st to 6th and 1039th to 1044th data lines 114 in which the difference of the display quality may easily occur, so that it will be appreciated that the display may be effected by a capacitive coupling between these data lines and pixels. For this reason, it will also be appreciated that the pixel regions corresponding to the 7th to 10th data lines 114 act as a buffer between the effective pixel regions and the 1st to 6th data lines in which the difference of the display quality may easily occur. Similarly, it will also be appreciated that the pixel regions corresponding to the 1035th to 1038th data lines 114 act as a buffer between the effective pixel regions and the 1039th to 1044th data lines in which the difference of the display quality may easily occur.

Figure 9:
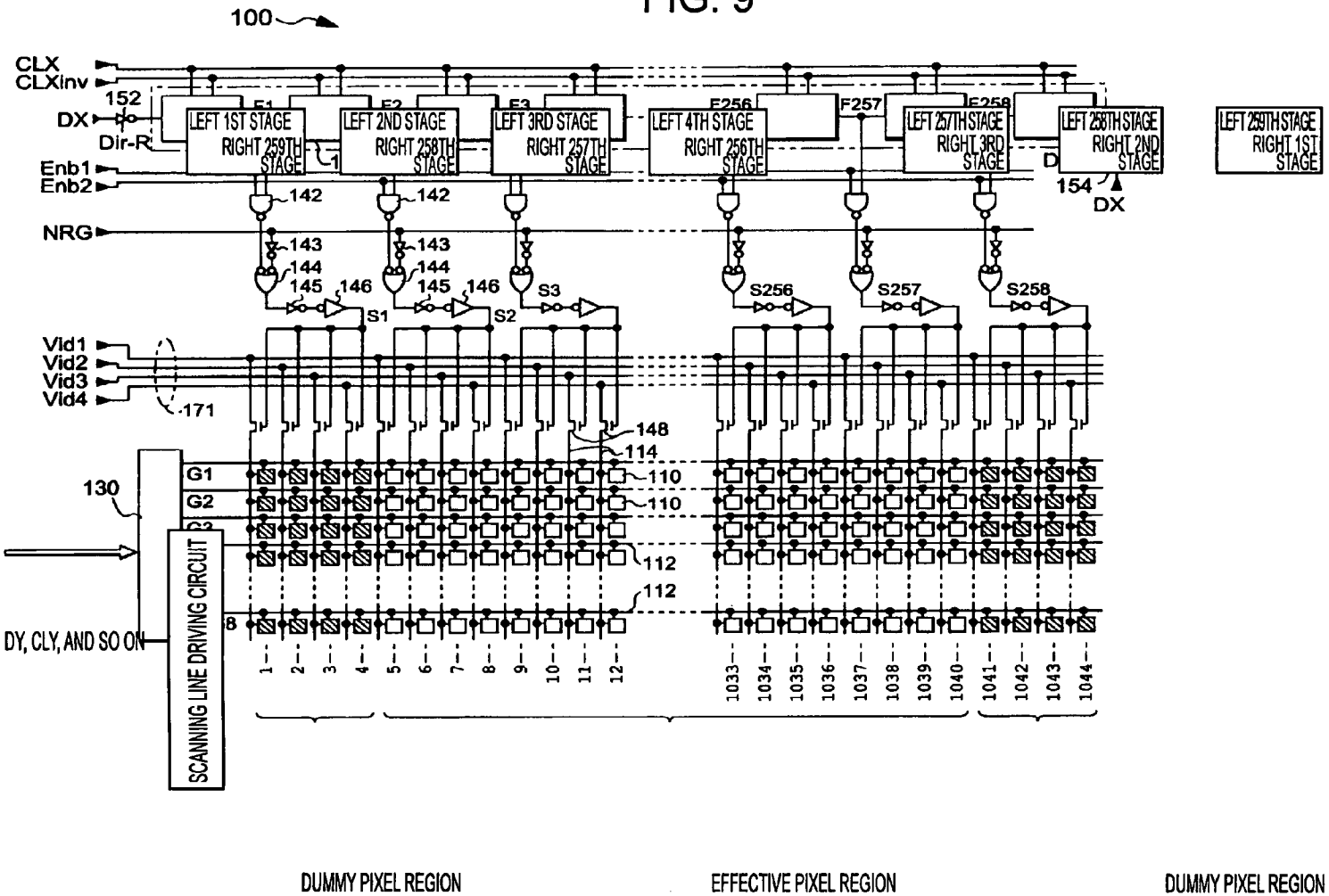
FIG. 9 is a diagram showing an arrangement of an electro-optical panel according to another embodiment of the present invention.

Further, in disregard of the role of the buffer, by using an arrangement in which the number of the data lines 114 in the effective pixel region is a multiple number of the number of the sampling switches 148 turned on and off at the same, time, for example, an arrangement in which the number of the data lines 114 where the image signals are sampled at the same time by the same sampling signal for the number of data lines 114 of '1024' in the effective pixel region, is '4', as shown in FIG. 9, the number of the pixels of '1024' in the horizontal direction is divisible into '4'. Therefore, it is not necessary to use another data lines besides data lines in which the image signals are sampled based on the signals output from the first stage of the shift register 140, as the dummy pixel regions.

In addition, while the present embodiment described above has described blackening the dummy pixel region that does not contribute to the display, examples of the non-display can be various types other than this.

For example, at first times, the pixel of the dummy pixel region is not the minimum gray scale, and may also be a color close to this, and may be a gray and a black color, or the maximum brightness.

At second times, only the data line 114 is used as the dummy pixel region, and the pixel 110 may not be partially or fully formed. In addition, the data line 114 may be omitted. However, when a voltage variation of the counter electrode dominates over a difference between the signal output from the first stage for the shift register 140 and the signal output from the other stage, as a factor of degradation of display quality, it is desirable that the pixel 110 in the dummy pixel region and the pixel 110 in the effective pixel region are the same from a need of preparing a degree of the capacitive coupling at the dummy pixel region and the effective pixel region.

At third times, whether or not the pixel 110 is formed, a light blocking layer (or liquid crystal) may be arranged corresponding to the portion as the dummy pixel region.

At any rate, preferably, pixels of the dummy pixel region may be discriminated from the pixels of the effective display region.

In addition, while the image data Vid is expanded into the image data Vd1*d* to Vd6*d* of 6 channels in the present embodiment described above, the number of channels is not limited to '6', and it may be '2'. Further, as described above, an arrangement in which the number of pixels in the horizontal direction specified by the display format is divisible, in other words, an arrangement in which the number of the data lines 114 of the effective pixel regions is a multiple number of the number of the sampling switch 148 turned on and off at the same time may be provided.

Further, while in the embodiments described above the processing circuit 300 processes digital image signals Vid, it may also process analog image signals. In addition, while the processing circuit 300 has an arrangement of S/P conversion followed by an analog conversion, but it may be an arrangement of the S/P conversion expansion followed by an analog conversion provided that the final result is the same analog signal.

Moreover, while the embodiments described above has been described in the context that low voltage effective values of the counter electrode 108 and the pixel electrode 118 have been described as a normal white mode for performing a white display, it may be called as a normal black mode for performing a black display.

While the embodiments described above uses a TN type liquid crystal, a bi-stable type liquid crystal having a memory characteristic such as ferroelectric liquid crystal and a BTN (Bi-stable twisted nematic) liquid crystal, a polymer dispersion type liquid crystal, or a GH (guest-host) type liquid crystal in which a dye (guest) having anisotropic due to absorption of visible light in a long axis direction and a short axis direction are resolved into a liquid crystal (host) of the constant molecular arrangement and the dye molecules are arranged in parallel with the liquid crystal molecules can be used.

In addition, a vertical alignment (homeotropic alignment) may be provided such that the liquid crystal molecules are vertically arranged with respect to both substrates when the voltage is not applied, while the liquid crystal molecules are horizontally arranged with respect to both substrates when the voltage is applied. A parallel (horizontal) alignment (homogenous alignment) may also be available such that the liquid crystal molecules are vertically arranged with respect to both substrates when the voltage is applied, while the liquid crystal molecules are horizontally arranged with respect to both substrates when the voltage is not applied. In this way, in the present invention, liquid crystal and alignment scheme may be applicable to various types.

While the liquid crystal device has been described, provided that the present invention has an arrangement such that the video data (video signal) is S/P expanded to supply across the image signal line, for example, it can be applied to a device such as an electronic luminescent device, an electron emission device, a electrophoretic device, a digital mirror device, and a plasma display.

<Electronic Apparatus>

Next, as an example of an electronic apparatus using the electro-optical device according to an embodiment of the present invention, a projector using the electro-optical panel 100 as a light valve will be described.

Figure 10:
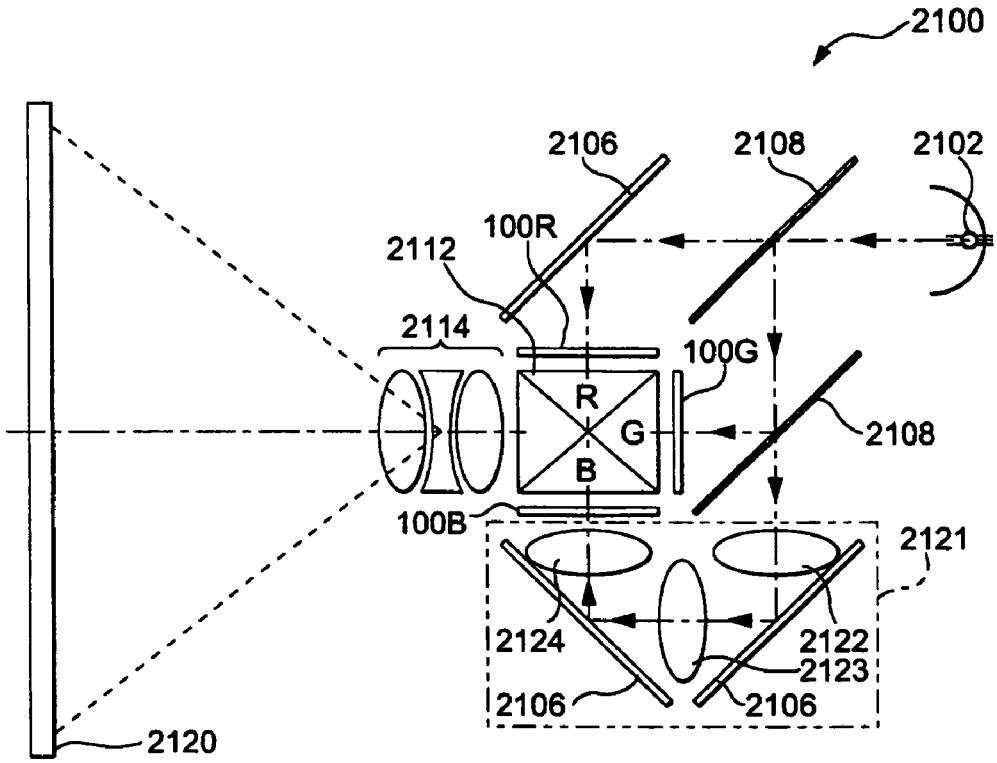
FIG. 10 is a diagram showing an arrangement of a projector adapted to the electro-optical panel according to an embodiment of the present invention.

FIG. 10 is a plan view showing an arrangement of the projector. As shown FIG. 12, a lamp unit 2102 having a white color light source such as a halogen lamp is arranged inside the projector 2100. Projection light emitted from the lamp unit 2102 are divided into the three primary colors R (red), G (green), and B (blue) by three mirrors 2106 and two dichroic mirrors 2108 arranged inside the projector 2100, and then is induced to light valves 100R, 100G, and 100B respectively corresponding to each primary color. In addition, since a B light component has a long optical length compared to R and G light components, a relay lens system comprising an incident lens 2122, a relay lens 2123, and an exit lens 2124 are induced to the optical path of the B light component, causing to prevent optical loss.

Here, the arrangements of the light valves 100R, 100G, and 100B have the same as that of the electro-optical panel 100 according to the embodiments described above, and are respectively driven by image signals corresponding to each color of R, G, and B supplied from a processing circuit (not shown in FIG. 10).

Light demodulated by the light valves 100R, 100G, and 100B, respectively, is incident into a dichroic prism from 3 directions. Further, in the dichroic prism 2112, the R light component and the B light component are refracted at 90 degrees, while the G light component propagates straight.

Therefore, after each color image is combined, a color image is projected to the screen 2120 through a projector lens 2114.

In addition, in the light valves 100R, 100G, and 100B, since light corresponding to each primary color R, G, and B is incident by the dichroic mirrors 2108, a color filter is not required. In addition, transmission images of the light valves 100R and 100B are reflected and then transmitted by the dichroic prism 2112, and the transmission image of the light valve 100G is just transmitted. Thus, the horizontal scanning direction by the light valves 100R and 100B are in the opposite direction to the horizontal scanning direction by the light valve 100G to display the left-right inverted image.

In addition, as an electronic apparatus, in addition to the example shown in FIG. 10, there can be employed a direct-vision type apparatus such as a mobile telephone, a personal computer, a television, a monitor of a video camera, a car navigation device, a pager, an electronic notebook, a calculator, a word processor, a workstation, a video call, a POS terminal, a digital still camera, and an apparatus having a touch panel. And, it is needless to say that the electro-optical device according to the present invention can be applied to these various electronic apparatuses.

What is claimed is:

1. An electro-optical device comprising:

scanning lines;

data lines intersecting the scanning lines, the data lines being divided into a plurality of data line groups including a first data line group with a plurality of dummy data lines only, a second data line group with a plurality of display data lines and with a plurality of dummy data lines, one of the plurality of dummy data lines of the second data line group being arranged adjacent to one of the plurality of dummy data lines of the first data line group, pixels corresponding to intersections of the scanning lines and the data lines, the pixels including display pixels that correspond to the display data lines of the second data line group, and dummy pixels that correspond to the dummy data lines of the first data line group and the second data line group;

a scanning line driving circuit for selecting one of the scanning lines every horizontal scanning period to sequentially select the scanning lines;

a shift register composed of a plurality of stages that are electrically connected to each other and that sequentially transmit a start pulse signal supplied at a beginning of each of the horizontal scanning periods, the shift register including a first stage corresponding to the plurality of dummy data lines of the first data line group and a second stage corresponding to the plurality of display data lines and the plurality of dummy data lines of the second data line group;

image signal lines for supplying signals;

a plurality of sampling switches electrically connected between the data lines and the image signal lines, the sampling switches including a first sampling switch group that corresponds to the first data line group and a second sampling switch group that corresponds to the second data line group, wherein sampling switches of the first sampling switch group are, based on the pulse signal transmitted at the first stage of the shift register, operated at substantially a same time to sample the signals supplied through the image signal lines and to substantially simultaneously transmit the sampled signals to the dummy data lines of the first data line group, and wherein sampling switches of the second sampling switch group are, based on the pulse signal transmitted at the second stage of the shift register, operated at substantially a same time to sample the signals supplied through the image signal lines and to substantially simultaneously transmit the sampled signals to the display data lines and to the dummy data lines of the second data line group;

a first operation circuit for implementing logical operation between a first enable signal and a first start pulse signal transmitted directly and only from the first stage of the shift register; and a second operation circuit for implementing logical operation between a second enable signal and a second start pulse signal transmitted directly and only from the second stage of the shift register, wherein output pulse widths of the first and second operation circuit do not overlap each other.

2. The electro-optical device according to claim 1, wherein a number of data lines is a multiple number of the number of the sampling switches turned on and off substantially at a same time based on the pulse signal transmitted at a corresponding stage of the shift register.

3. The electro-optical device according to claim 1, further comprising:

an operation circuit for calculating logical operation signals of a predetermined enable signal and the start pulse signals transmitted from each stage of the shift register such that pulse widths thereof do not overlap each other, wherein the sampling switches corresponding to a same group turn on and off according to a same logical operation signal.

4. The electro-optical device according to claim 3, wherein each image signal is extended along a time axis according to a number of image signal lines by synchronizing signals designating gray-scale levels of the pixels with the supply of the enable signal, and wherein each image signal is distributed to the image signal line so as to be supplied to the data line turned on by the sampling switch.

5. The electro-optical device according to claim 1, wherein a number of data lines in an effective pixel region is a multiple number of the number of the sampling switches turned on and off substantially at a same time based on the pulse signal transmitted at a corresponding stage of the shift register.

6. The electro-optical device according to claim 1, further comprising:

a third data line group with a polarity of display data lines only, wherein dummy pixel regions are symmetrically located with respect to a center of the third data line group for performing display.

7. An electro-optical device comprising:

scanning lines;

data lines intersecting the scanning lines, the data lines including a first data line group with a plurality of dummy data lines only, a second data line group with a plurality of display data lines and with a plurality of dummy data lines, one of the plurality of dummy data lines of the second data line group being arranged adjacent to one of the plurality of dummy data lines of the first data line group;

pixels corresponding to intersections of the scanning lines and the data lines, the pixels including display pixels that correspond to the display data lines of the second data line group, and dummy pixels that correspond to the dummy data lines of the first data line group and the second data line group, the dummy pixels corresponding to the dummy data lines;

a shift register comprising a plurality of stages that are electrically connected to each other, the shift register including a first stage in one transmission direction electrically connected to the plurality of dummy data lines of the first data line group and a second stage in one transmission direction electrically connected to the plurality of display data lines and the plurality of dummy data lines of the second data line group;

image signal lines;

sampling switches electrically connected between the data lines and the image signal lines, each of the sampling switches corresponding to one of the data lines;

a first operation circuit for implementing logical operation between a first enable signal and a first start pulse signal transmitted directly and only from the first stage of the shift register; and a second operation circuit for implementing logical operation between a second enable signal and a second start pulse signal transmitted directly and only from the second stage of the shift register, wherein output pulse widths of the first and second operation circuit do not overlap each other.

* * * * *